US005400837A

United States Patent [19]

Kelley et al.

[11] Patent Number: 5,400,837

[45] Date of Patent: Mar. 28, 1995

[54] MULTI-STATION FILLING APPARATUS AND PROCESS FOR FILLING BULK CONTAINERS

[75] Inventors: Robert G. Kelley, South Jordan; Christopher S. Wadium; Don G. Giles, both of Salt Lake City, all of Utah

[73] Assignee: Stone Container Corporation, Chicago, Ill.

[21] Appl. No.: 147,392

[22] Filed: Nov. 4, 1993

[51] Int. Cl.[6] ..... B65B 1/04; B65B 3/04

[52] U.S. Cl. ..... 141/10; 141/114; 141/163; 141/173; 141/314

[58] Field of Search ..... 141/10, 68, 83, 114, 141/163, 166, 168, 171, 173, 176, 313, 314, 315, 316

[56] References Cited

U.S. PATENT DOCUMENTS

| | | | |
|---|---|---|---|
| 1,667,930 | 5/1928 | Edmunds | 141/314 |
| 1,686,404 | 10/1928 | Callahan | 141/114 |
| 3,215,173 | 11/1965 | Rutherford | 141/83 |
| 3,406,727 | 10/1968 | Rexus | 141/131 |
| 4,676,284 | 6/1987 | DeCrane | 141/114 |
| 4,700,755 | 10/1987 | Banys | 141/114 |
| 5,238,032 | 8/1993 | McGregor | 141/114 |

FOREIGN PATENT DOCUMENTS

| | | |
|---|---|---|
| 0004604 | 1/1990 | Japan . |
| 3418300 | 11/1985 | Netherlands . |

OTHER PUBLICATIONS

Stone Container Corporation's (Assignee of present application) Model P-1000 Bulk Bag Filling System (no available date).

Stone Container Corporation (Assignee of present application) Model S-1000 Bulk Bag Filling System (no available date).

*Primary Examiner*—Ernest G. Cusick
*Assistant Examiner*—Steven O. Douglas
*Attorney, Agent, or Firm*—Dick and Harris

[57] ABSTRACT

A multi-station filling apparatus and process for filling bulk containers while simultaneously enabling the deployment and staging of at least one empty container while at least one other container is being filled. The apparatus includes a container filling station operably positioned adjacent a substantially elevated filling chute, a container deployment station, a rotatable carriage and an automatic apparatus controller. The container deployment station is spaced apart from the container filling station so that an operator can attach an empty container thereat either prior to, or during, filling of another container at the container filling station—while avoiding physical exposure to any mechanisms, such as conveyors, associated with the container filling station. The rotatable carriage, which automatically rotates an empty container from the container deployment station toward and into the empty container filling station, includes an outer frame member and displaceable inner frame members. The inner frame members are displaceable from the outer frame members at the container filling station toward operable cooperation with the elevated filling chute, as well as for transferring of the weight of the inner frame member and attached container onto an elevated weight scale mechanism.

29 Claims, 8 Drawing Sheets

20
58
59
60
26
57
57
80
A1
B2
51
130
115
44
22
24

20
26
75
59
58
B1
A2
50
51
130
115
44
24
22

20
B2
26
59
58
A2
80
50
51
115
130
44
24
22

MULTI-STATION FILLING APPARATUS AND PROCESS FOR FILLING BULK CONTAINERS

BACKGROUND OF THE INVENTION

The present invention relates to bulk container filling machines, and, more particularly, to a multi-station filling apparatus and process for filling bulk containers while simultaneously enabling the deployment and staging of at least one empty container while at least one other container is being filled.

Filling apparatuses for filling bulk containers, and, more particularly, Flexible Intermediate Bulk Containers ("FIBC") have been known in the art for several years. Such filling apparatuses have typically comprised a single station for accommodating attachment of an empty FIBC, filling the FIBC and then removal of same. Examples of such prior art apparatuses include Applicant's own model S-1000 and model P-1000 Bulk Bag Filling Systems. Although such prior art apparatuses do effectively fill an attached FIBC, they can become less efficient when more than one FIBC is to be filled with a specific material at any given time.

The filling cycle associated with the filling of material into an FIBC typically ranges from only a few minutes to in excess of thirty minutes. Furthermore, once the FIBC is filled, replacement time associated with removal, and attachment of another empty FIBC, takes approximately four minutes to accomplish —assuming that the operator removes and replaces the filled FIBC immediately after filling has completed. Nonetheless, this "idle" time, associated with the single station apparatus, results in lost production time and increased cost.

The prior art has additionally disclosed filling apparatuses which incorporate multi-filling stations. Examples of such prior art are: Rutherford, U.S. Pat. No. 3,215,173 and Rexus, U.S. Pat. No. 3,406,727. Specifically, Rutherford, '173 discloses a rotating turn-table wherein a filling tube continuously feeds material into a ring-shaped filling hopper and then eventually into a bag. The bags themselves are rotated toward and into a filling position where the hopper discharges the material therein. Rexus, '727 discloses a rotating carousel wherein the filling tube of the carousel rotates to a specific filling station. Although such prior art does disclose multi-station filling apparatuses having position movable features, none of such prior art discloses a multi-station filling apparatus having a movable carriage which simultaneously rotates inner and outer frame members and, in turn, a container to be filled, between a container deployment station and a spatially separated container filling station, and, wherein the inner frame member is displaceable from the outer frame member, at the container filling station, toward operable attachment to a stationary filling chute and transfer of the load of same to an elevated scale member. In addition, none of such prior art discloses, much less suggests, the use of material settling means operably associated with an underlying container support for settling the material within the container at predetermined time or weight intervals during the filling process to, in turn, maximize the filling capacity of the container itself, in the environment of a multi-station filling system.

It is thus an object of the present invention to provide a multi-station filling apparatus which includes at least one container filling station and at least one container deployment station, safely spaced apart from the filling station, so that an empty container can be safely attached to the apparatus simultaneously with the filling of another container at the container filling station—to, in turn, substantially eliminate idle, non-productive filling time.

It is also an object of the present invention to provide a multi-station filling apparatus which comprises a movable carriage which automatically rotates an empty container at the container deployment station toward and into operable positioning at the container filling station.

It is still further an object of the present invention to provide a multi-station filling apparatus wherein the movable carriage includes an outer frame member and displaceable inner frame members which rotate in unison with the outer frame member, and, wherein an inner frame member is substantially released from the outer frame member at the container filling station, and then raised toward and into operable contact with an elevated filing chute and weighing mechanism.

These and other objects of the present invention will become apparent in light of the present Specification, Claims and Drawings.

SUMMARY OF THE INVENTION

The present invention comprises a multi-station filling apparatus for the facilitated alignment, filling, conveyance and transporting of relatively large material containers, such as flexible intermediate bulk containers of the type having suspension means for operable attachment of the containers to the apparatus, while simultaneously facilitating the deployment and staging of at least one such empty container. The apparatus includes one or more container filling station means, each operably and fixedly aligned with a corresponding elevated substantially stationary filling chute for filling corresponding ones of the containers with a desired amount of material. Each of the container filling station means include container support means operably and distally positioned below each of the elevated filling chutes for providing an underlying support to each of the containers during at least a portion of the filling of same with the desired amount of the material.

Conveying means are operably positioned in aligned cooperation with the container support means for facilitating conveyance of filled ones of the containers to a container take-off area. At least one container deployment station means is operably positioned at a location apart from the one or more container filling station means, associated container support means and the conveying means, for enabling attachment of a first empty container to the multi-station filling apparatus either prior to the operable positioning and filling of the first empty container at the container filling station means, or, simultaneously with the filling of another one of the containers at the container filling station means.

One or more of the at least one container deployment station means are positioned at a location apart from the container filling station means, container support means and the conveying means, so as to enhance the isolation and safety of an operator involved with the attachment of the first empty container to the multi-station filling apparatus—without the operator having to stand on conveyers, rollers or the like.

Movable carriage means are operably associated with each of the empty, filling and filled containers, and both of the container filling station means and the container deployment station means, for operably suspending the containers, as well as for reorienting the first empty container from the container deployment station means into operable alignment of the first empty container at one of the container filling station means, to, in turn, enable operable filling of the first empty container with a desired amount of the material from the respective elevated stationary filling chute. The movable carriage means includes container attachment means which are operably associated therewith for releasable securement of the suspension means of the respective material containers to the movable carriage means. The container attachment means release the suspension means of the container, and, in turn, the container itself, to the container support means of the container filling station means, and, in turn, to the conveying means, after the container has been filled with a desired amount of material.

Control means are used for operably controlling the reorientation of the first empty container from one of the container deployment station means into operable alignment with the container filling station means. Such alignment enables the container to be filled with the material being discharged from the elevated substantially stationary filling chute, the discharge of material from the elevated stationary filling chute into each of the containers operably positioned at the one or more container filling station means, and the release of the filled containers to the container conveying means, together with the conveying of the released and filled containers to the container take-off area.

In the preferred embodiment of the invention, the multi-station filling apparatus further includes displacement means operably associated with at least one of the one or more container filling station means for altering the degree of contact between each of the containers with a corresponding one of the container support means as the container is filled at the one or more container filling stations. The altering of the degree of contact between each of the containers being filled at the one or more container filling stations serves to substantially preclude inadvertent wrinkling of the containers during various stages of filling of the containers with the material, as well as to facilitate settling of the material within the containers to, in turn, enhance the efficient filling of same with the material.

In this preferred embodiment, the displacement means comprises elevating means which are operably associated with at least a portion of the movable carriage means for elevating the containers being filled at the one or more container filling station means at various degrees of operable contact with the container support means.

The apparatus further includes weighing scale means which are operably associated with at least one of the one or more container filling station means for weighing the containers during various stages of filling of same with the material. The scale means comprise displacement means which are operably associated with at least one of the one or more container filling station means. The displacement means comprise at least a portion of the movable carriage means being elevatable for controlled periodic elevation and suspension of the containers within the one or more container filling station means above and out of operable contact with the container support means. Additionally, displacement means serve to transfer the weight of the containers being filled, and, in turn, the material within the containers, to a scale member for operable suspended weighing of same.

In the preferred embodiment of the invention, the movable carriage means comprises a rotatable carriage assembly for rotating containers between the container deployment station means and the one or more filling station means.

In this preferred embodiment of the invention, the scale means are operably associated with the one or more container filling station means for weighing the containers during filling of same with the material at one of the one or more container filling station means. In this embodiment, the movable carriage means further comprises an outer frame member and at least one inner frame member supported by the outer frame member, wherein at least a portion of each of the respective outer and inner frame members are reciprocally repositionable relative to one another when positioned at the one or more container filling station means.

The multi-station filling apparatus further includes inner frame detachment means operably associated with the scale means at the one or more filling station means for enabling operable disengagement and raising of the at least one inner frame member, independent from the outer frame member of the movable carriage means. The inner frame detachment means are operably associated with the scale means to transfer the weight of the inner frame means and the container, at the various degrees of filling, from the outer frame member to at least a portion of the scale means.

The movable carriage means further includes guide means operably associated with at least one inner frame member and the outer frame member for operably maintaining the at least one inner frame member in operable alignment with the outer frame member during and after the disengagement and raising of at least one of the inner frame members from the outer frame member.

In the preferred embodiment of the invention, the multi-station filling apparatus further includes material settling means operably associated with the container filling station means for enhancing the settling of the material within the containers at the container filling station means, to, in turn, enable efficient and expeditious filling of the containers with the material.

In one embodiment, the container settling means preferably comprises deflatable expansion means for enabling relatively abrupt and repeatative jolting of the material during the various stages of filling of the container at the container filling station means. The deflatable expansion means are operably positioned at the container filling station means.

In another embodiment, the container settling means preferably comprises material vibration means for vibrating the material during various stages of filling of the container at the container filling station means. The material vibration means are also operably positioned at the filling container station means.

In another preferred embodiment of the invention, the multi-station filling apparatus further includes pallet dispensing means operably associated with the container support means for supplying one or more pallets to each of the container filling station means prior to operable positioning of the containers at the container filling station means. The pallet supplied from the pallet dispensing means facilitates removal of the filled containers from the take-off area of the conveying means through conventional material handling equipment. Accordingly, it is also contemplated that the control means further includes automatic pallet dispensing means for automatically controlling the dispensing of the pallets from the pallet dispensing means.

In the preferred embodiment of the invention, the multi-station filling apparatus further includes position detection means operably positioned along, and associated with, the conveying means for sensing operable alignment and positioning of the containers, to, in turn, substantially preclude inadvertent operation of the conveying means, the movable carriage means and the discharge of the material from the elevated stationary filling chute.

In the preferred embodiment of the control means, these control means further include automation means for automatically controlling: the reorienting of the first empty container from the container deployment station means into operable alignment with the container filling station means so as to automatically enable the container to be filled with the material being discharged from the elevated substantially stationary filling chute, the automatic discharge of material from the elevated substantially stationary filling chute into each of the containers operably positioned at the one or more container filling station means, the automatic release of the filled containers to the container conveying means, and the automatic conveying of the released and filled containers to the container take-off area.

The invention further includes a process of filling, conveying and transporting relatively large material containers, on a multi-station filling apparatus, such as flexible intermediate bulk containers of the type having suspension means for releasable attachment of one or more containers to such a multi-station filling apparatus. The process comprises the steps of a) attaching a first container to releasable attachment members of a movable carriage assembly at one or more container deployment stations; b) rotating the movable carriage assembly, and, in turn, the releasably attached first container from the one or more container deployment stations toward and into operable alignment with a substantially stationary elevated filling chute at one or more container filling stations, wherein the substantially stationary elevated filling chute is operably positioned at one of the one or more container filling stations and is capable of discharging the material therefrom; c) discharging the material from the substantially stationary elevated filling chute toward the first container; e) filling the first container with the material discharging from the substantially stationary elevated filling chute; f) releasably attaching a second container to additional releasable attachment members suspended from the removable carriage assembly at the one or more container deployment stations, simultaneously with the filling of the first container operably positioned at one of the one or more container filling stations; g) terminating the discharge of the material from the substantially stationary elevated filling chute after the first container has been filled with a desired amount of material; h) releasing the filled first container from the releasable attachment members at one of the one or more filling stations into operable cooperation with the conveyer positioned at the first filling station; i) conveying the filled first container to a take-off area; j) rotating the carriage assembly to reposition the attached second container from one of the one or more container deployment stations into operable alignment with the substantially stationary elevated filling chute at one of the one or more container filling stations toward subsequent filling with the material; and k) removing from further material handling the filled first container from the take-off area.

In a preferred embodiment of the invention, the process for filling, transporting and conveying one or more containers on a multi-station filling apparatus further includes the step of settling the material within the first container prior to the step of releasing the filled first container from the releasable attachment members, with the step of settling the material within the container serving to facilitate the efficient and expedited filling of the container within the material.

In this preferred embodiment, the step of settling the material in the first container further includes the step of vibrating the container, and, in turn, the material therewithin. Alternatively, or in addition thereto, the step of settling the material in the first container may also include the step of jolting the container, and, in turn, the material therewithin.

The step of settling the material in the container further includes the step of settling such material after predetermined weight intervals associated with the container and material therewithin have been reached during filling. Alternatively, such settling may be commenced at predetermined time intervals.

The process for filling, transporting and conveying one or more containers on a multi-station filling apparatus preferably further includes the step of weighing, at least once, the material in the first container prior to the step of releasing the first container from the releasable attachment members. In this embodiment, the step of weighing the material in the first container comprises the steps of a) engaging the inner member, and, in turn, the first container at the container filling station with a weighing mechanism; b) displacing the inner member from an outer member of the movable carriage member at the container filling station; and c) weighing the first container, and, in turn, the material therewithin, prior to the step of releasing the first container from the releasable attachment members.

In another preferred embodiment, the process of filling, transporting and conveying one or more containers in a multi-station filling apparatus further includes the step of dispensing a pallet from a pallet dispenser into operable alignment with at least a portion of the conveyer at the container filling station prior to the step of discharging the material from the substantially stationary elevated filling chute into the container.

In this embodiment, the step of releasing the filled container from the releasable attachment members into operable cooperation with the conveyer further includes the step of releasing the filled container onto the pallet operably dispensed from the pallet dispenser. Such dispensing of the pallet can be done through automatic control of same.

In the preferred embodiment of the invention, the process of filling, transporting and conveying one or more containers in a multi-station filling apparatus further includes the step of automatically controlling: attaching of the first container to the releasable attachment members, rotating of the movable carriage assembly, and, in turn, the releasably attached first container from the container deployment station toward and into operable alignment with the substantially stationary elevated filling chute, moving of the first container into operable alignment with the substantially stationary elevated filling chute, discharging of the material from the substantially stationary elevated filling chute into the first container, filling of the first container with the material discharging from the substantially stationary elevated filling chute, attaching of the second container to additional releasable attachment members at the container deployment station, simultaneously with the filling of the first container operably positioned at the container filling station, stopping of the discharge of the material from the substantially stationary elevated filling chute after the first container has been filled with the desired amount of the material, releasing of the filled first container from the releasable attachment members into operable contact with the conveyer, conveying of the filled first conveyer to the take-off area, rotating of the releasably attached second container from the container deployment station into operable alignment with the substantially stationary elevated filling chute at the container filling station, and removing of the filled container from the take-off area.

The process of filling, transporting and conveying one or more containers in the multi-station filling apparatus further includes the step of detecting the operable positioning and alignment of the one or more containers through one or more sensors operably associated with the container filling station and conveyer. Such detection serves to reduce the risk of potential hazards should the one or more containers be out of such operable positioning and alignment during either of the steps of: rotating the movable carriage assembly, discharging the material from the substantially stationary elevated filling chute into the first container, and for conveying the filled container to the take-off area, respectively.

BRIEF DESCRIPTION OF THE DRAWINGS

FIG. 9 of the drawings is an elevated fragmentary side view of the displacement means of the multi-station filling apparatus showing, in particular, the substantially deflated air bags, the operable distal positioning between the lifting bars and receiving bars of the inner frame member, as well as showing the inoperative filling positioning between the substantially elevated filling chute and the receiving spout of the corresponding inner frame member.

DETAILED DESCRIPTION OF THE DRAWINGS

Figure 1:
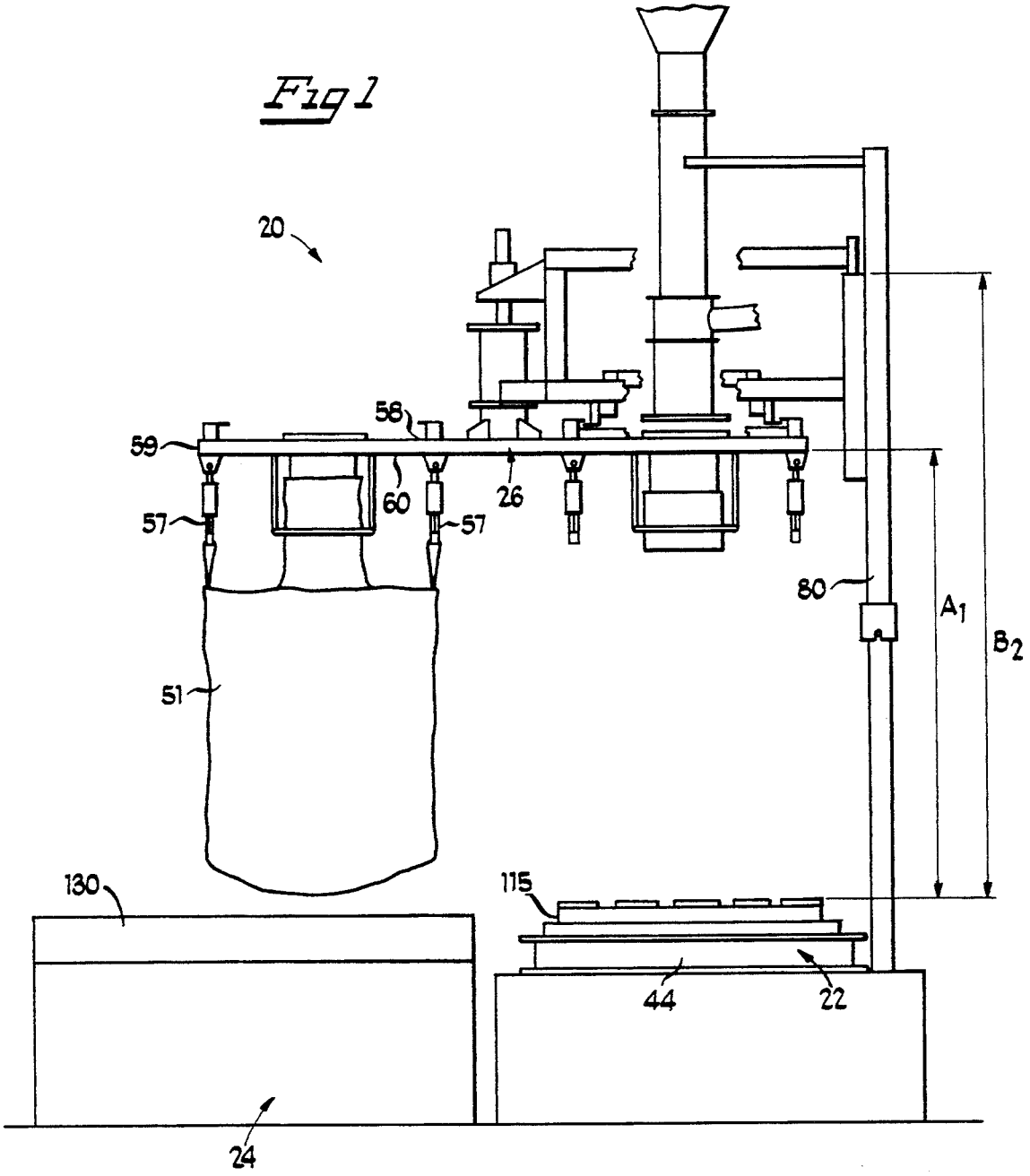
FIG. 1 of the drawings is an elevated front view of the multi-station filling apparatus showing, in particular, the container filling station means, container deployment station means, elevating means and an empty container operably attached to the container attachment means of a corresponding inner frame member.

While this invention is susceptible of embodiment in many different forms, there is shown in the drawings and will herein be described in detail, several specific embodiments with the understanding that the present disclosure is to be considered as an exemplification of the principals of the invention and is not intended to limit the invention to the embodiments illustrated.

Figure 4:
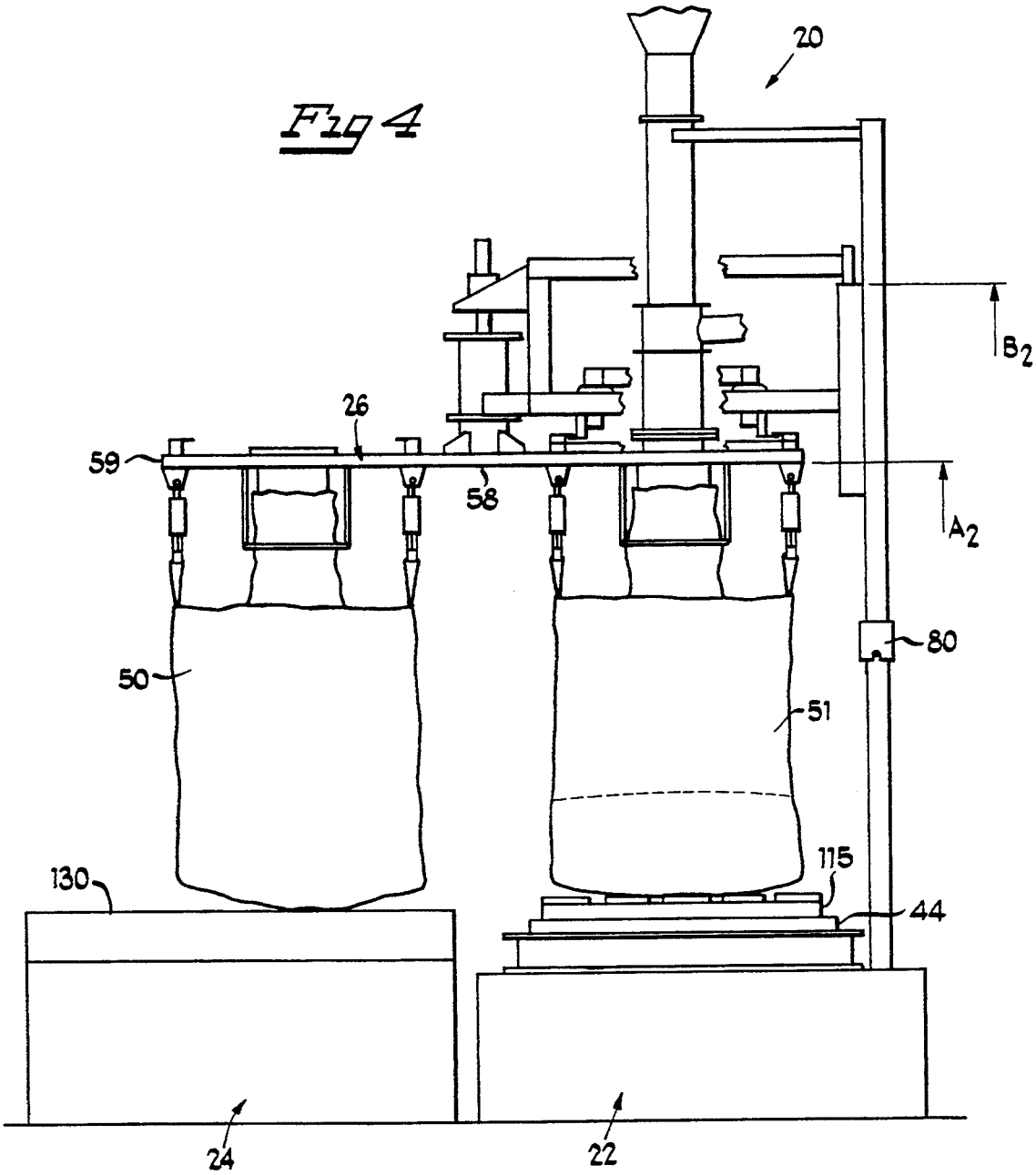
FIG. 4 of the drawings is an elevated front view of the multi-station filling apparatus of FIG. 1 showing, in particular, a container at the container filling station means positioned in operable contact with an underlying pallet, and, in turn, the container support means, so as to facilitate settling of the material therewithin.
Figure 5:
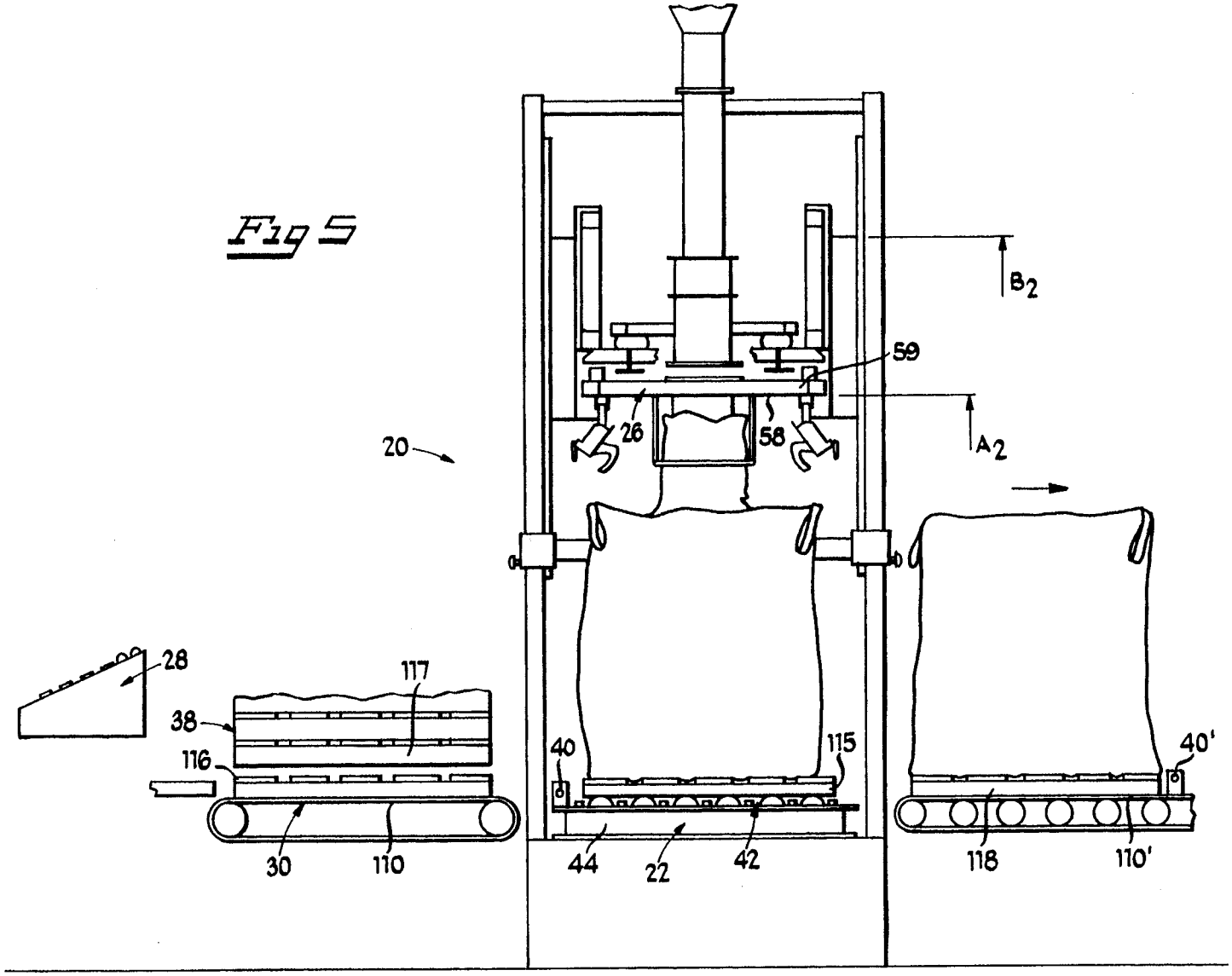
FIG. 5 of the drawings is an elevated side view of a portion of the multi-station filling apparatus showing, in particular, the control means, pallet dispensing means, container filling station means, a released filled container positioned on an underlying pallet, and, another previously filled container staged at the pallet take-off area.
Figure 6:
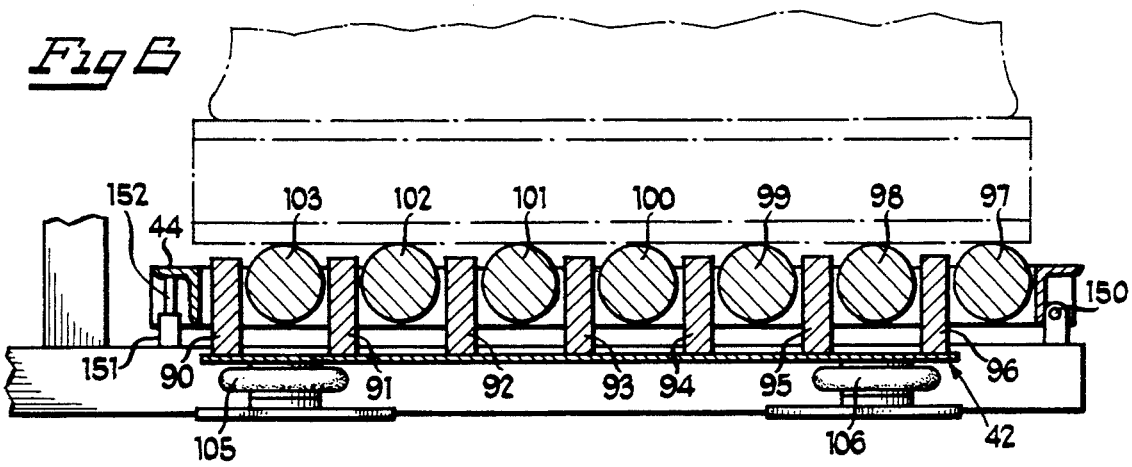
FIG. 6 of the drawings is an elevated cross-sectional view of the container support means showing, in particular, the rollers for conveying a pallet, and, in turn, a filled container, the slats of material settling means and the inflatable air bags which operably raise and lower the slats above the conveying rollers for purposes of settling the material within the container.
Figure 7:
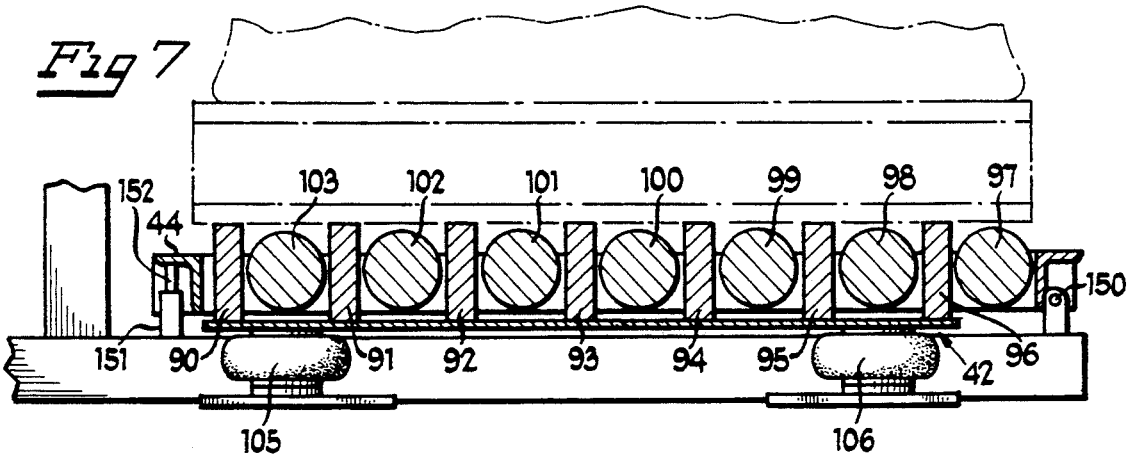
FIG. 7 of the drawings is an elevated cross-sectional view of the container support means and material settling means of FIG. 6 showing, in particular, the partially inflated air bags and, in turn, the partially raised slats of the material settling means above the conveying rollers.
Figure 8:
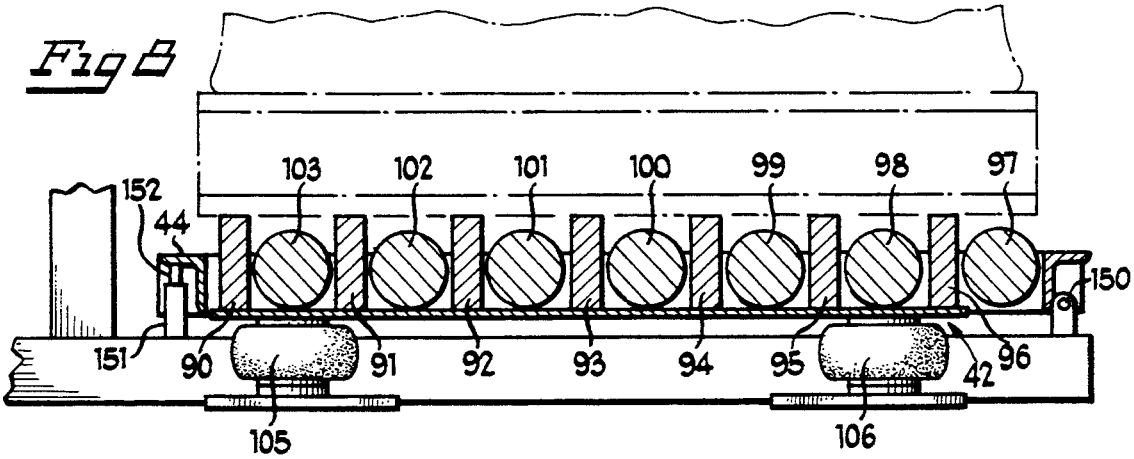
FIG. 8 of the drawings is an elevated cross-sectional view of the container support means and material settling means of FIG. 6 showing, in particular, the fulled inflated air bags, and, in turn, the fully raised slats of the material settling means above the conveying rollers.
Figure 5:
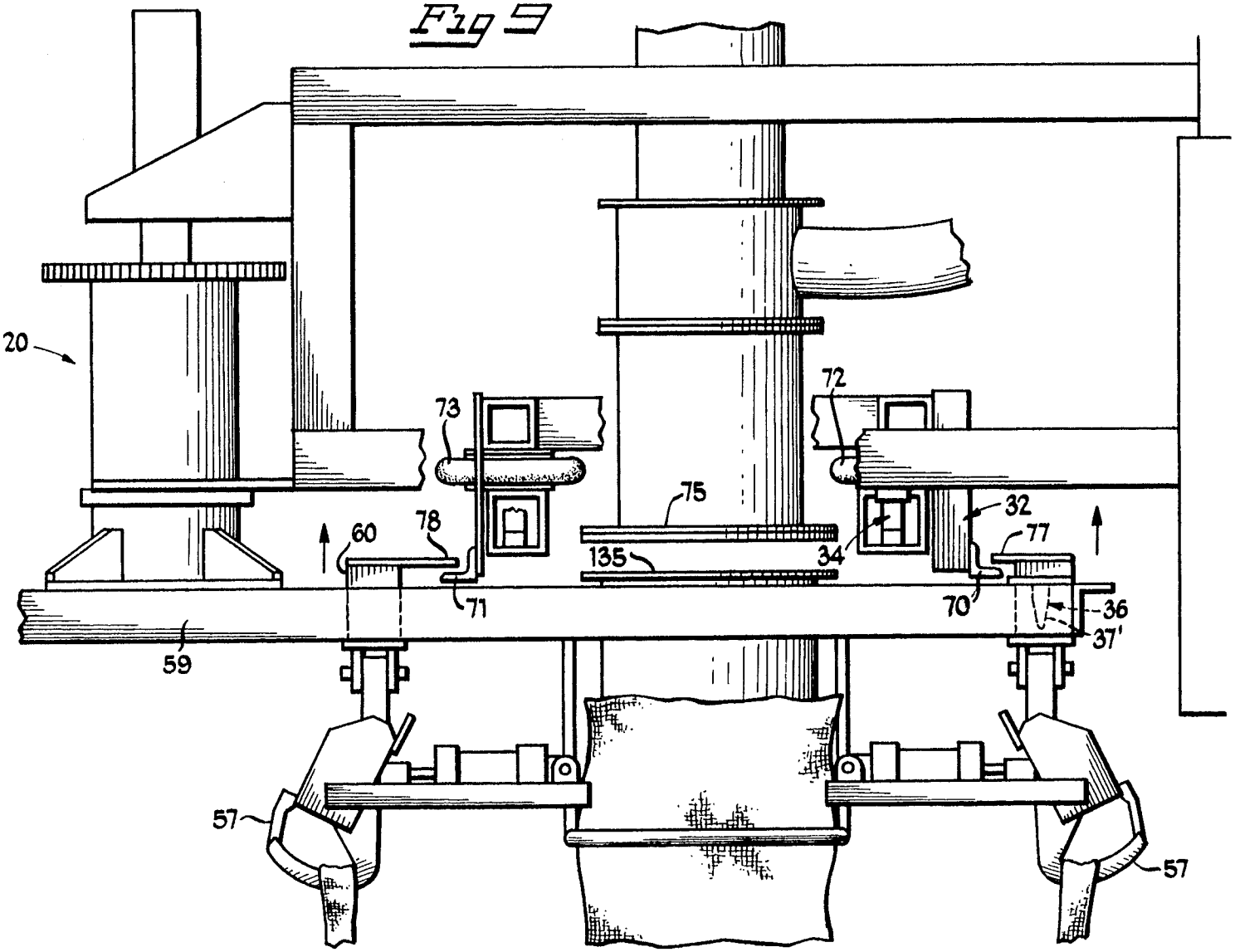

Multi-station filling apparatus 20 is shown in FIGS. 1, 2, 3 and 5 as comprising container filling station means 22 (FIG. 1 and FIG. 3), container deployment station means 24 (FIG. 1), movable carriage means 26, control means 28 (FIG. 5), container deployment means 30 (FIG. 5), displacement means 32 (FIG. 9 and FIG. 10), scale means 34 (FIG. 9), guide means 36 (FIG. 9), pallet dispensing means 38 (FIG. 5), position detection means 40, 40' (FIG. 5) and material settling means 42 (FIGS. 6–8). Container filling station means 22 includes container support means 44 which is used to provide an underlying support to each of the containers, such as container 51 (FIG. 4), and, in turn, to a pallet, such as pallet 115, which is operably dispensed from pallet dispensing means 38. Container deployment station means 24 includes platform 130.

Movable carriage means 26 includes container attachment means 57 (FIG. 1 and FIG. 9), rotatable carriage assembly 58, outer frame member 59, inner frame members 60 and 61 (FIG. 2) and inner frame detachment means. As explained herein, the inner frame detachment means are operably associated with displacement means 32 (FIG. 9) for enabling disengagement and, in turn, raising of the respective inner frame member, such as inner frame member 60, positioned at container filling station means 22, independent from outer frame member 59. Indeed, such disengagement of the respective inner frame member is accomplished as the result of displacement means 32, which are shown in FIG. 9 as comprising lifting bars 70 and 71 and inflatable air bags 72 and 73.

Figure 10:
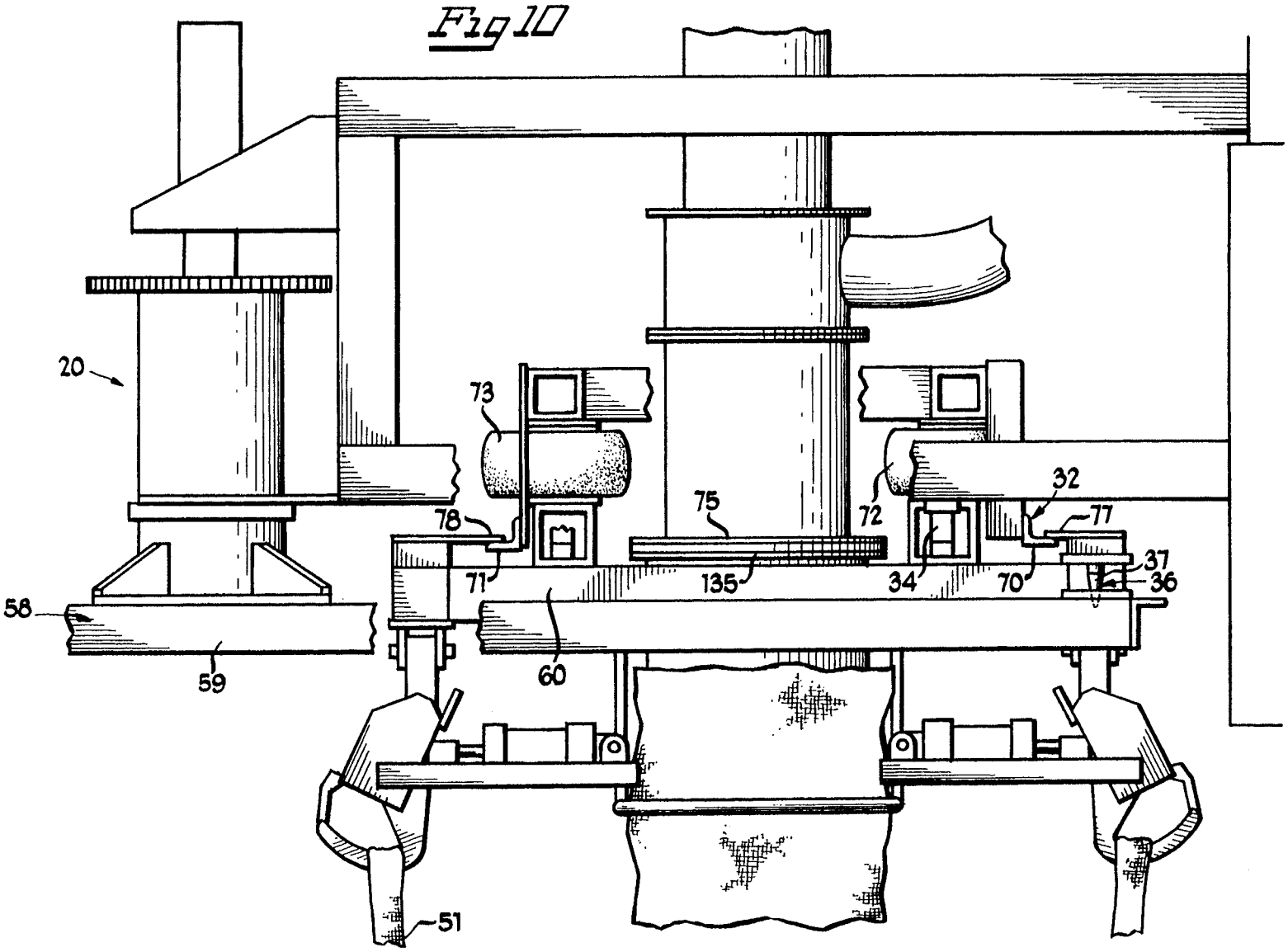
FIG. 10 of the drawings is an elevated fragmentary side view of the displacement means of the multi-station filling apparatus of FIG. 9 showing, in particular, the substantially inflated air bags, the elevated displaced positioning of the inner frame member from the outer frame member at the container filling station means, and further showing, the operable connection between the substantially elevated filling chute and the receiving spout of the inner frame member.

Air bags 72 and 73 will automatically inflate prior to filling of a container, such as container 51, at filling station means 22. As the air bags inflate, they will force lifting bars 70 and 71 upward in the direction of the arrows, as shown in FIG. 9, toward and into operable engagement with receiving bars 77 and 78 (FIG. 9) of inner frame member 60. Upon such engagement, and as the air bags continue to inflate, the inner frame member will become operably detached from outer frame member 59, and, in turn, from rotatable carriage assembly 58, as shown in FIG. 10. After the air bags have been fully inflated, the filling spout 135 (FIG. 9), of inner frame member 60, will be in operable filling contact with substantially elevated filing chute 75 of apparatus 20, as shown in FIG. 10, and the load associated with the corresponding inner frame member and suspended container 51 will be transferred to scale means 34—thereby providing continuous suspended weighing of the container and material therein during the filling process. Although scale means 34 is shown as comprising load cells, other conventional weighing mechanisms, including platform scales, are also contemplated for use.

Figure 2:
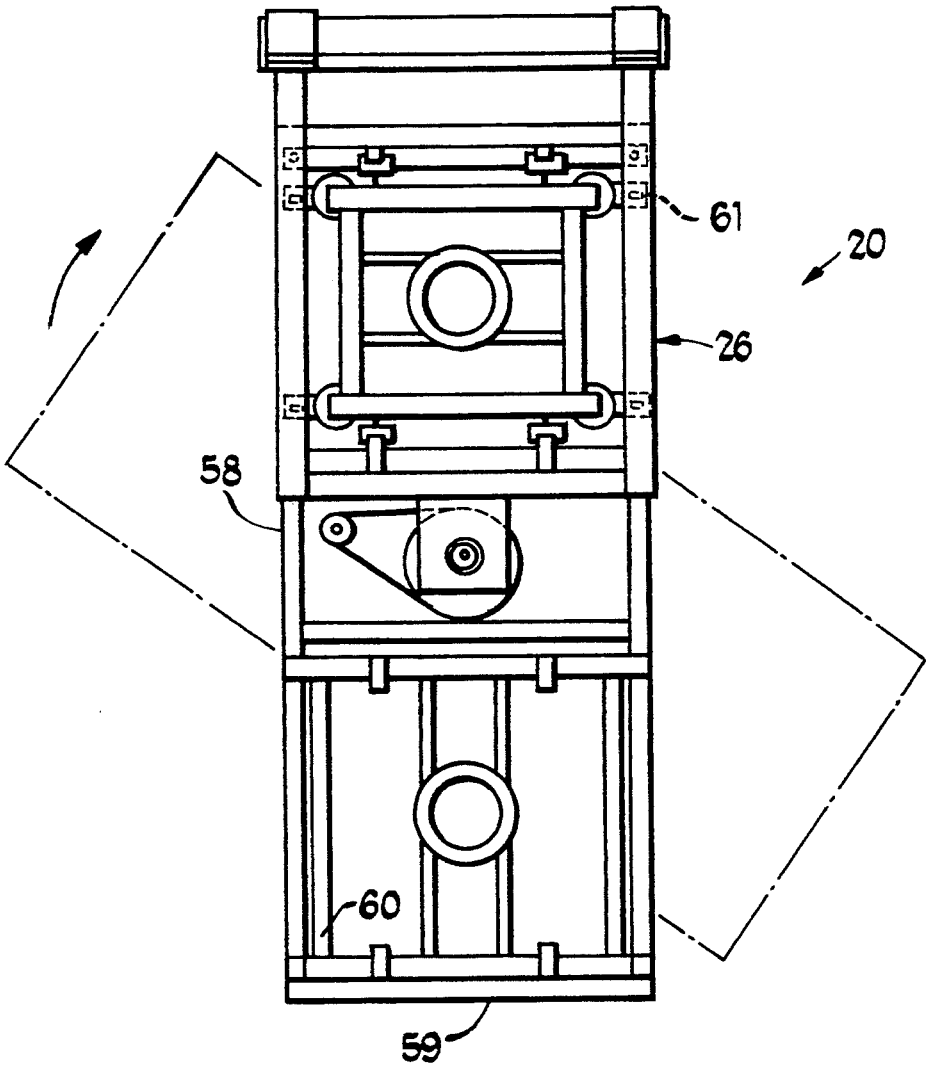
FIG. 2 of the drawings is a top plan view of the multi-station filling apparatus of FIG. 1 showing, in particular, the movable carriage means and direction of rotation thereof, and the two inner frame members operably attached to the outer frame member during rotation.
Figure 3:
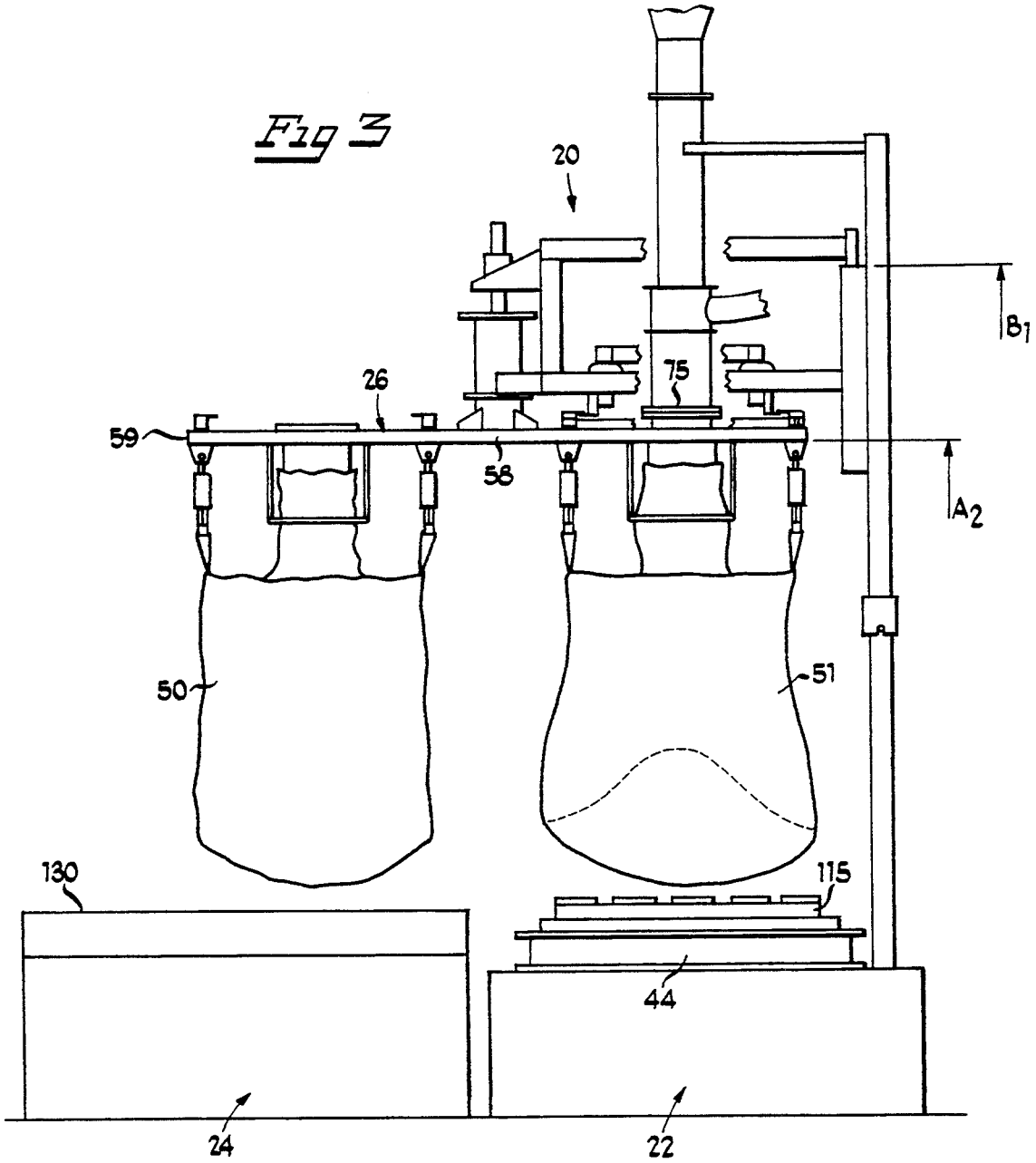
FIG. 3 of the drawings is an elevated front view of the multi-station filling apparatus of FIG. 1 showing, in particular, an empty container operably positioned at the container deployment station means, a partially filled container operably positioned at the container filling station means, container support means and a pallet operably positioned thereon.

Repositioning of inner frame member 60 back into operable cooperation with outer frame member 59, after the filling process has completed, is accomplished by deflation of air bags 72 and 73. Furthermore, guide means, such as guide means 36 (FIG. 9 and FIG. 10), are operably associated with the inner and outer frame members to ensure proper re-alignment therebetween. The guide means comprise positioning pins, such as positioning pin 37 (FIG. 10), and pin receiving regions, such as pin receiving region 37' (FIG. 9). Each of the positioning pins are operably attached to the inner frame member, such as inner frame member 60, and each of the pin receiving regions are operably formed in a corresponding portion of outer frame member 59. Accordingly, such repositioning and, in turn, re-alignment, will enable unitary rotation of movable carriage means 26 when rotating an empty container from container deployment station means 24 toward and into container filling station means 22 (FIGS. 2–4).

Elevating means 80 are shown in FIG. 1, as comprising an hydraulic cylinder which simultaneously raises and lowers the entire inner and outer frame members, 60, 61 and 59, respectively. Accordingly, when the frame members are raised, movable carriage means 26 can be freely rotated so as to, for example, preclude snagging of the bottom of an attached empty container, such as empty container 50 (FIG. 3), during rotation of the empty container toward and into operable positioning at container filling station means 22. Additionally, such elevated positioning of the inner and outer frame members will likewise serve to raise the container to be filled with material at container filling station means 22, high enough above pallet 115, and, in turn, container support means 44, so as to substantially eliminate the formation of any creases or folds which may otherwise result in the bottom of the container during initial filling with material.

Material settling means 42 are shown in FIGS. 6–8 as comprising a plurality of slats, such as slats 90–96, operably positioned adjacent conveyor rollers 97–103 in container support means 44, and inflatable air bags, such as air bags 105 and 106. These air bags, like air bags 72 and 73 (FIG. 9) associated with displacement means 32, are believed to be commercially available from Firestone Tire Co. Furthermore, although air bags are shown for purposes of raising and lowering various components on multi-station filling apparatus 20, other types of conventional lifting means, such as hydraulic or pneumatic jacks, are also contemplated for use. Also shown in FIGS. 6–8 are hinge 150 and lifting cylinder 151 having lifting ram 152. Lifting cylinder 151 with ram 152, when in its extended orientation (FIG. 6), elevates the non-hinged portion of container support means 44 to extend conveyor rollers 97–103, and, in turn, a portion of container support means 44, beyond the tops of slats 90–96 to, in turn, transfer the pallet load to rollers 97–103. Accordingly, the elevated orientation will facilitate the conveyance of the respective pallet and container positioned thereon, to the pallet take-off area. Alternatively, when the ram 152 is retracted by cylinder 151 (as shown in FIG. 8) the associated pallet and container will be in operable contact with slats 90–96 to enable settling of the material within the respective container by jolting as described herein—while isolating rollers 97–103 from said jolting-settling stresses.

Should settling of material within container 51, at container filling station means 22, be desired during or after the filling process, such settling can be accomplished by lowering the container, and, in turn, the inner and outer frame members, through displacement of elevating means 80 (FIG. 4), until container 51 is operably resting upon underlying pallet 115, and, in turn, upon container support means 44. Once such positioning has occurred, air bags, such as air bags 105 and 106 will inflate so as to force slats 90–96 to elevate above top of rollers 97–103, as shown in FIG. 7 and FIG. 8. After the slats have been completely elevated (FIG. 8), the air bags will be quickly deflated to a point where the tops of the slats 90–96 will be maintained at least partially above the tops of rollers 97–103, as shown in FIG. 7. Such a quick partial deflation, coupled with the downward force associated with the weight of the material within container 51, will result in an abrupt jolting to the container, and in turn, the material therewithin. Although such settling has been described as comprising a jolting action, it is also contemplated that the settling be accomplished through a vibrating motion imparted through the slats. It is also contemplated that the settling occur at predetermined time or weight intervals during the filling process.

Pallet dispensing means 38 is shown in FIG. 5 as comprising conveyer 110, pallet support member (not shown) and a stack of pallets, such as pallets 116, 117. The pallet support member may comprise a conventional fork lift wherein the tines of the fork lift maintain the entire stack of pallets above conveyor 110 until a pallet is needed. Should a pallet be needed at container support means 44, control means 28 (FIG. 5) will automatically cause the fork lift to lower the entire stack of pallets onto conveyor 110 and then re-raise all of the pallets, other than bottom pallet 116 therefrom. Accordingly, control means 28 will then cause conveyor 110 to convey pallet 116 toward and onto container support means 44 at container filling station means 22.

Also shown in FIG. 5 are position detection means 40 and 40'. These position detection means, which are shown as comprising electric eyes, serve to identify whether the containers, such as containers 115 and 118, are operably positioned and aligned on multi-station filling apparatus 20. Should detection means 40 or 40' detect any inoperable positioning, control means 28 will automatically stop and preclude any further operations associated with the filling and or automatic positioning of any containers and/or pallets.

With respect to the process for attaching, positioning and filling the containers on multi-station filling apparatus 20, an operator physically steps onto platform 130 at container deployment station means 24, and then manually connects empty container 51 to container attachment means 57, as shown in FIG. 1. It is important to note that container deployment station means 24 is located separate and apart from container filling station means 22, so that an operator can safely attach the empty container to the container attachment means without any physical contact with any rollers and/or conveyers. Accordingly, such isolated positioning of the container deployment station means will substantially reduce the likelihood of injury which may otherwise result to the operator. In addition, such an arrangement also facilitates attachment of the empty container to apparatus 20, either prior to, or simultaneously with the filling of another container, such as container 50, as shown in FIG. 3, to reduce costs.

After empty container 51 (FIG. 1) has been operably attached to container attachment means 57 of the corresponding inner frame member 60, at container deployment station means 24, control means 28 will be activated so as to cause elevating means 80 (FIG. 1) to raise inner and outer frame members 60, 61 and 59, respectively, and, in turn, the container itself, and then cause rotatable carriage assembly 58 to rotate the empty container toward and into operable alignment with substantially stationary filling chute 75 (FIG. 3) at container filling station means 22. Once such operable alignment has occurred, displacement means 32 (FIG. 9) will automatically elevate inner frame member 60 into operable engagement with substantially elevated filling chute 75, as shown in FIG. 10, while simultaneously causing the weight of the container and respective inner frame member, to be transferred to scale means 34.

After the empty container has been operably engaged with the filling chute, material will automatically begin to discharge therefrom. Elevating means 80 will maintain the entire outer frame member 59, as well as inner frame members 60 and 61, in an elevated orientation (FIG. 3), wherein the container to be filled is temporarily maintained above underlying pallet 115 until enough material has filled the container to, in turn, substantially preclude the formation or existence of any folds or creases which may otherwise result at or near the bottom of the container if such initial filling commenced while the container was actually resting on the pallet. Thereafter, elevating means 80 will cause the inner and outer frame members to lower (FIG. 4) while inner frame member 60 (FIG. 10), at container filling station means 22, remains displaced from outer frame member 59, and the spout 135 of inner frame member remains in operable contact with substantially elevated filling chute 75 (FIG. 4).

As container 51 continues to be filled with material, uneven filling within the container may result—potentially leading to the container being filled to less than its maximum capacity. Accordingly, settling of the material within the container at various stages of such filling, is contemplated by either abrupt jolting or vibration of the containers in the manner previously described herein.

After appropriate settling of the material within the container has been obtained, and after a predetermined target weight associated with the amount of material filled within the container at container filling station means 22 has been reached, inflatable air bags 72 and 73 (FIG. 10) adjacent lifting bars 70 and 71, will automatically deflate. As the air bags are deflating, inner frame member 60 will be released from operable contact with substantially elevated filling chute 75 (FIG. 9) and then be guided back into operable engagement with outer frame member 59 as the result of the intercooperation between positioning pins, such as positioning pin 37 (FIG. 10) and the positioning pin receiving region, such as receiving region 37' (FIG. 9) of outer frame member 59. After such operable engagement has been obtained, the filled container will be substantially resting upon underlying pallet 115 (FIG. 5). At that point, control means 28 will automatically cause container attachment means 57 to release the straps of container 51, wherein such straps, and, in turn, the container itself, will slidably disengage from operable contact with inner frame member 60.

Upon release of the filled container onto the underlying pallet, and upon detection of such positioning by position detection means 40, control means 28 will activate rollers 97–103 (FIG. 5), of container support means 44, and then convey the filled container and associated pallet toward and onto pallet take-off area 110' (FIG. 5) where it will remain until removed. In addition, during, or immediately after the filled container is being relocated toward and onto the pallet take-off area, rotatable carriage assembly 26 will once again rotate, as shown in FIG. 2, until another empty container (which was previously attached to the corresponding container attachment means, at the container deployment station means, while the filled container was being filled) is operably positioned at container filling station means 22 where the entire process will repeat.

Although multi-station filling apparatus 20 is shown as comprising only one filling station and one deployment station, it is also contemplated that multiple filling and deployment stations, as well as multiple inner frame members for attachment and positioning of multiple containers, also be used. Indeed, such a multi-station configuration is contemplated so as to enable simultaneous automatic filling, attachment and operable rotation of one, or several containers.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A multi-station filling apparatus for the facilitated alignment, filling, conveyance and transporting of relatively large material containers such as flexible intermediate bulk containers of the type having suspension means for operable attachment of the containers to the apparatus, while simultaneously facilitating the deployment and staging of at least one such empty container, said multi-station filling apparatus comprising:

one or more container filling station means, each operably and fixedly aligned with a corresponding elevated substantially stationary filling chute for filling corresponding ones of said containers with a desired amount of said material, each of said container filling station means including container support means operably and distally positioned below each said elevated filling chute for providing an underlying support to each of said containers during at least a portion of the filling of same with said desired amount of said material;

conveying means operably positioned in aligned cooperation with said container support means for facilitating conveyance of filled ones of said containers to a container take-off area;

at least one container deployment station means operably positioned at a location apart from said one or more container filling station means, associated container support means and said conveying means, for enabling attachment of a first empty container to said multi-station filling apparatus alternatively prior to the operable positioning and filling of said first empty container at said container filling station means, as well as simultaneously with the filling of another one of said containers at said container filling station means, one or more of said at least one container deployment station means being positioned at said location apart from said container filling station means, container support means and conveying means, to enhance the isolation and safety of an operator involved with the attachment of said first empty container to said multi-station filling apparatus;

movable carriage means operably associated with each of said empty, filling and filled containers and both said container filling station means and said container deployment station means, for operably suspending said containers, as well as for reorienting said first empty container from said container deployment station means into operable alignment of said first empty container at one of said one or more container filling station means, to, in turn, enable operable filling of said first empty container with a desired amount of said material from said respective elevated stationary filling chute;

said movable carriage means including container attachment means operably associated therewith for releasable securement of the suspension means of the respective material containers to said movable carriage means;

said container attachment means releasing said suspension means of said container, and, in turn, said container itself, to said container support means of said container filling station means, and, in turn, to said conveying means, after said container has been filled with said desired amount of said material; and control means for operably controlling the reorientation of said first empty container from one of said one or more container deployment station means into said operable alignment with said container filling station means so as to enable said container to be filled with said material being discharged from said elevated substantially stationary filling chute, the discharge of material from said elevated stationary filling chute into each of said containers operably positioned at said one or more container filling station means, and the release of said filled containers to said container conveying means, together with the conveying of said released and filled containers to said container take-off area.

2. The invention according to claim 1 wherein the multi-station filling apparatus further includes displacement means operably associated with at least one of said one or more container filling station means for altering the degree of contact between each of said containers with a corresponding one of said container support means as said container is filled at said one or more container filling stations, said altering of the degree of contact between each said container being filled at said one or more container filling stations serving to substantially preclude inadvertent wrinkling of said containers during various stages of filling of said containers with said material, as well as to facilitate settling of said material within said containers to, in turn, enhance the efficient filling of same with said material.

3. The invention according to claim 2 in which said displacement means comprises elevating means operably associated with at least a portion of said movable carriage means for elevating said containers being filled at said one or more container filling station means at various degrees of operable contact with said container support means.

4. The multi-station filling apparatus according to claim 3 in which the invention further includes weight scale means operably associated with at least one of said one or more container filling station means for weighing said containers during various stages of filling of same with said material.

5. The invention according to claim 4 wherein said weight scale means comprises displacement means operably associated with at least one of said one or more container filling station means, said displacement means comprising at least a portion of said movable carriage means being elevatable for controlled periodic elevation and suspension of said containers within said one or more container filling station means above and out of operable contact with said container support means;

said displacement means transferring the weight of said containers being filled, and, in turn, said material within said containers, to a scale member for operable suspended weighing of same.

6. The invention according to claim 1 in which said movable carriage means comprises a rotatable carriage assembly for rotating containers between said container deployment station means and said one or more filling station means.

7. The multi-station filling apparatus according to claim 1 in which the invention further includes weight scale means operably associated with said one or more container filling station means for weighing said containers during filling of same with said material at one of said one or more container filling station means.

8. The invention according to claim 7 wherein said movable carriage means further comprises an outer frame member and at least one inner frame member supported by said outer frame member wherein at least a portion of each of said respective outer and inner frame members are reciprocally repositionable relative to one another when positioned at said one or more container filling station means, said container attachment means being operably attached to said at least one inner frame member;

said multi-station filling apparatus further including inner frame detachment means operably associated with said scale means at said one or more filling station means for enabling operable disengagement and raising of said at least one inner frame member, independent from said outer frame member of said movable carriage means, said inner frame detachment means being operably associated with said scale means to transfer the weight of said inner frame means and said container, at said various degree of filling, from said outer frame member to at least a portion of said scale means.

9. The invention according to claim 8 wherein said movable carriage means further includes guide means operably associated with said at least one inner frame member and said outer frame member for operably maintaining said at least one inner frame member in operable alignment with said outer frame member during and after said disengagement and raising of said at least one inner frame member from said outer frame member.

10. The invention according to claim 1 wherein the multi-station filling apparatus further includes material settling means operably associated with said container filling station means for enhancing the settling of said material within said containers at said container filling station means, to, in turn, enable efficient and expeditious filling of said containers with said material.

11. The invention according to claim 10 wherein said container settling means comprises deflatable expansion means for enabling relatively abrupt and repetitive jolting of said material during said various stages of filling of said container at said container filling station means., said deflatable expansion means being operably positioned at said container filling station means.

12. The invention according to claim 10 wherein said container settling means comprises material vibration means for vibrating said material during various stages of filling of said container at said container filling station means, said material vibration means being operably positioned at said container filling station means.

13. The invention according to claim 1 wherein the multi-station filling apparatus further includes pallet dispensing means operably associated with said container support means for supplying one or more pallets to each of said container filling station means prior to operable positioning of said containers at said container filling station means, said pallets supplied from said pallet dispensing means facilitating removal of said filled containers from said take-off area of said conveying means through material handling equipment.

14. The invention according to claim 13 wherein said control means further includes automatic pallet dispensing means for automatically controlling the dispensing of said pallets from said pallet dispensing means.

15. The invention according to claim 1 wherein the multi-station filling apparatus further includes position detection means operably positioned along and associated with, said conveying means for sensing operable alignment and positioning of said containers, to, in turn, substantially preclude inadvertent operation of said conveying means, said movable carriage means and the discharge of said material from said elevated stationary filling chute.

16. The invention according to claim 1 in which said control means further includes automation means for automatically controlling the reorienting of said first empty container from said container deployment station means into said operable alignment with said container filling station means so as to automatically enable said container to be filled with said material being discharged from said elevated substantially stationary filling chute, the automatic discharge of material from said elevated stationary filling chute into each of said containers operably positioned at said one or more container filling station means, the automatic release of said filled containers to said container conveying means, and the automatic conveying of said released and filled containers to said container take-off area.

17. A process for filling, conveying and transporting relatively large material containers, on a multi-station filling apparatus, such as flexible intermediate bulk containers of the type having suspension means for releasable attachment of one or more containers to such a multi-station filling apparatus, the process comprising the steps of:

attaching a first container to releasable attachment members of a movable carriage assembly at one or more container deployment stations;

rotating the movable carriage assembly, and, in turn, the releasably attached first container from said one or more container deployment stations toward and into operable alignment with a substantially stationary elevated filling chute at one or more container filling stations, said substantially stationary elevated filling chute being operably positioned at one of said one or more container filling stations so as to be capable of discharging said material therefrom;

discharging the material from the substantially stationary elevated filling chute toward said first container;

filling the first container with the material discharging from the substantially stationary elevated filling chute;

releasably attaching a second container to additional releasable attachment members suspended from said movable carriage assembly at said one or more container deployment stations, simultaneously with the filling of the first container operably positioned at one of said one or more container filling stations;

terminating the discharge of the material from the substantially stationary elevated filling chute after the first container has been filled with a desired amount of the material;

releasing the filled first container from the releasable attachment members at one of said one or more filling stations into operable cooperation with a conveyor positioned at said first filling station;

conveying the filled first container to a take-off area;

rotating the carriage assembly to reposition the attached second container from one of said one or more container deployment stations into operable alignment with the substantially stationary elevated filling chute at one of said one or more container filling stations toward subsequent filling with the material; and removing for further material handling the filled first container from the take-off area.

18. The invention according to claim 17 in which the process for filling, transporting and conveying one or more containers on a multi-station filling apparatus further includes the step of settling the material within the first container prior to the step of releasing the filled first container from the releasable attachment members, the step of settling the material within the container serving to facilitate efficient and expedited filling of the container with the material.

19. The process according to claim 18 in which the step of settling the material in the first container further includes the step of vibrating the container, and, in turn, the material therewithin.

20. The process according to claim 18 in which the step of settling the material in the first container further includes the step of jolting the container, and, in turn, the material therewithin.

21. The process according to claim 18 in which the step of settling the material in the container further includes the step of settling the material therewithin after predetermined weight intervals associated with the container and material therewithin have been reached during filling.

22. The process according to claim 18 in which the step of settling the material in the container further includes the step of settling the material therewithin at predetermined time intervals.

23. The invention according to claim 17 in which the process for filling, transporting and conveying one or more containers on a multi-station filling apparatus further includes the step of weighing at least the material in the first container at least once, prior to the step of releasing the first container from the releasable attachment members.

24. The process according to claim 23 in which the step of weighing the material in the first container comprises the steps of:

engaging the inner member, and, in turn, the first container at the container filling station with a weighing mechanism;

displacing the inner member from an outer member of the movable carriage member at the container filling station; and weighing the first container, and, in turn, the material therewithin at least once, prior to the step of releasing the first container from the releasable attachment members.

25. The invention according to claim 23 in which the step of dispensing the pallet from the pallet dispenser further includes the step of automatically controlling the dispensing and alignment of the pallets dispensed from the pallet dispenser.

26. The invention according to claim 17 in which the process of filling, transporting and conveying one or more containers in a multi-station filling apparatus further includes the step of dispensing a pallet from a pallet dispenser into operable alignment with at least a portion of the conveyor at the container filling station prior to the step of discharging the material from the substantially stationary elevated filling chute into said container.

27. The invention according to claim 26 in which the step of releasing the filled container from the releasable attachment members into operable cooperation with the conveyor further includes the step of releasing the filled container onto the pallet operably dispensed from the pallet dispenser.

28. The invention according to claim 17 in which the process of filling, transporting and conveying one or more containers in a multi-station filling apparatus further includes the step of automatically controlling said attaching of the first container to the releasable attachment members, rotating of the movable carriage assembly to, in turn, rotate the releasably attached first container from the container deployment station toward and into operable alignment with the substantially stationary elevated filling chute, moving of the first container into operable alignment with the substantially stationary elevated filling chute, discharging of the material from the substantially stationary elevated filling chute into the first container, filling of the first container with the material discharging from the substantially stationary elevated filling chute, attaching of the second container to additional releasable attachment members, at the container deployment station, simultaneously with the filling of the first container operably positioned at the container filling station, stopping of the discharge of the material from the substantially stationary elevated filling chute after the first container has been filled with the desired amount of the material, releasing of the filled first container from the releasable attachment members into operable contact with the conveyor, conveying of the filled first conveyor to the take-off area, rotating of the releasably attached second container from the container deployment station into operable alignment with the substantially stationary elevated filling chute at the container filling station, and removing of the filled container from the take-off area.

29. The invention according to claim 17 in which the process of filling, transporting and conveying one or more containers in a multi-station filling apparatus further includes the step of detecting the operable positioning and alignment of the one or more containers through one or more sensors operably associated with the container filling station and conveyor, so as to reduce the risk of potential hazards should the one or more containers be out of such operable positioning and alignment, simultaneously with each of the steps of rotating the movable carriage assembly, discharging the material from the substantially stationary elevated filling chute into the first container, and, conveying the container to the take-off area, respectively.

* * * * *